United States Patent [19]

Sano

[11] Patent Number: 4,584,955

[45] Date of Patent: Apr. 29, 1986

[54] FINE-FEED ADJUSTING DEVICE OF A SEWING MACHINE

[75] Inventor: Yasuro Sano, Hachioji, Japan

[73] Assignee: Janome Sewing Machine Co. Ltd., Tokyo, Japan

[21] Appl. No.: 662,950

[22] Filed: Oct. 19, 1984

[30] Foreign Application Priority Data

Oct. 26, 1983 [JP] Japan ..... 58-164569[U]

[51] Int. Cl.[4] ..... D05B 3/04

[52] U.S. Cl. ..... 112/315; 112/446

[58] Field of Search ..... 112/315, 158 B, 316, 112/158 E

[56] References Cited

U.S. PATENT DOCUMENTS

| | | | |
|---|---|---|---|
| 4,103,632 | 8/1978 | Bowles | 112/158 E |
| 4,145,982 | 3/1979 | Kume et al. | 112/315 |
| 4,167,912 | 9/1979 | Sedlatschek et al. | 112/158 E |

*Primary Examiner*—Werner H. Schroeder
*Assistant Examiner*—Andrew M. Falik
*Attorney, Agent, or Firm*—Michael J. Striker

[57] ABSTRACT

In a sewing machine having a feed adjusting device which is operated by means of a drive pulse motor, a feed adjusting member is pivoted relative to an attaching member such that the feed adjusting member is turned about an axis of an output shaft of the pulse motor by rotating a fine feed-adjusting member, an eccentric part of which is mounted in a groove formed in the feed adjusting member so that a fine adjustment of the feed pitch may be provided.

4 Claims, 6 Drawing Figures

FINE-FEED ADJUSTING DEVICE OF A SEWING MACHINE

BACKGROUND OF THE INVENTION

The present invention relates to a fine-feed adjusting device for a sewing machine, and more particularly to a device for fine adjustments of feed pitches of left-hand and right-hand stitchings, used especially in a buttonhole stitching.

In conventional pattern stitchings formed by the sewing machines, discrepancies have occurred in feed pitches between a forward feed and a backward feed due to types of fabrics, threads, pressing pressure and other factors, and the patterns have often appeared to be awkward. Especially in the buttonhole stitchings, if the left-hand stitching is on the forward feed and the right-hand side stitching is on the backward feed, and if the feed pitches of each feed do not coincide with each other, the stitchings become non-satisfactory. Therefore, a fine adjustment of the feed pitch has been necessary. There have been many proposals where machine operators handle appropriate adjusting members during the running of the sewing machine in order to finely adjust the feed pitches. However, the sewing machine, in which a pulse motor is a power source which actuates a feed adjusting device, is complicated in structure and expensive, and is also not durable.

SUMMARY OF THE INVENTION

It is an object of the present invention to provide a fine-adjusting device, in which, defects of the conventional devices would be eliminated.

This and other objects of the invention are attained by a fine-feed adjusting device for a sewing machine provided with a feed adjustment device actuated by means of a drive pulse motor having an output shaft and mounted to an attaching member secured to a machine frame of the sewing machine, comprising a feed adjusting member mounted on said attaching member, and pivotable relative to said output shaft such that it is turned about an axis of said output shaft; a drive gear mounted on said output shaft; a follower gear meshed with said drive gear and pivotally supported at an end of said feed adjusting member; means for operating the feed adjustment device including a feed rotation shaft rotatably pivoted to the machine frame, and a feed adjusting arm secured on the feed rotation shaft; a connecting rod pivotable between said feed adjusting arm and said follower gear; and a fine-feed adjusting member rotatably supported in said attaching member and having an eccentric portion inserted in a groove formed in said feed adjusting member, said fine-feed adjusting member being rotated by an external force so as to turn said feed adjusting member to make a fine adjustment to a feed pitch.

BRIEF DESCRIPTION OF THE DRAWINGS

FIGS. 3 to 5 show various operation steps of the fine-feed adjusting device, wherein FIG. 3 is a side view of the device in the position in which a feed pitch is zero, FIG. 4 is a side view of the device with a slightly available feed pitch at a forward feed, as compared to the stage shown in FIG. 3, and FIG. 5 is a side view of the device with a slightly available feed pitch at a backward feed, as compared to the stage shown in FIG. 3.

DETAILED DESCRIPTION OF THE INVENTION

Figure 1:
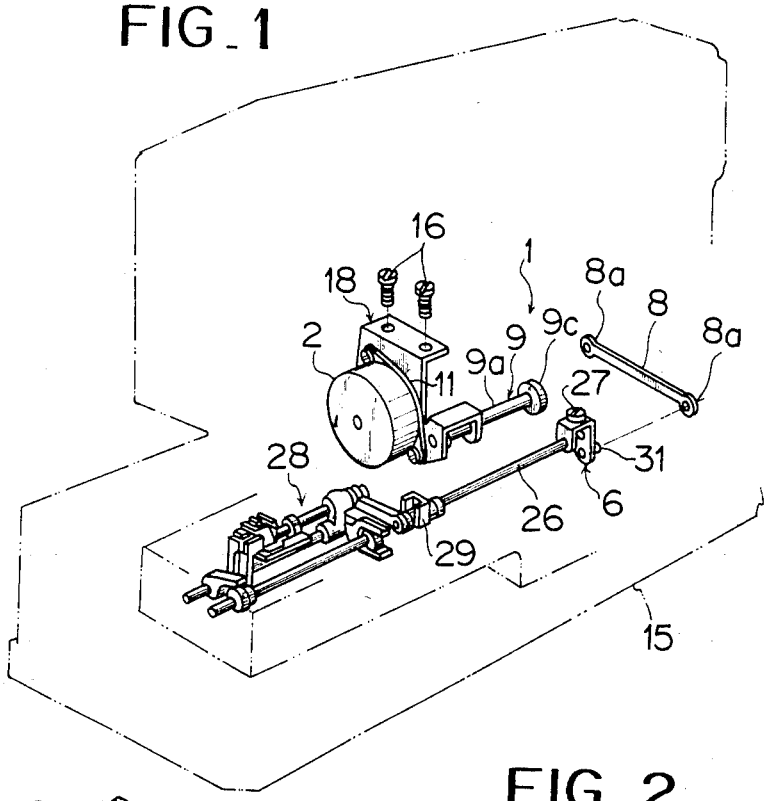
FIG. 1 is a perspective view showing a section of a fine-feed adjusting device.
Figure 2:
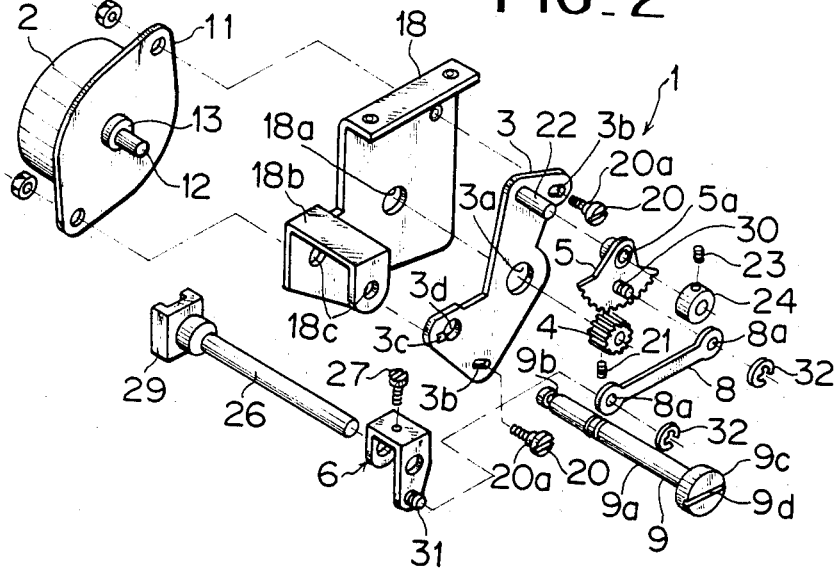
FIG. 2 is an exploded perspective view of the fine-feed adjusting device.

A fine feed-adjusting device 1 according to the invention comprises a pulse motor 2, a feed adjusting member 3, a drive gear 4, a follower gear 5, a feed adjusting arm 6, a connecting rod 8 and fine feed-adjusting control member 9.

The pulse motor 2 is fixed with an attaching plate 11, from which an output shaft 12 extends. The output shaft 12 is provided thereon with a bush 13 which is restrained in an axial direction. The pulse motor 2 is connected to an attaching member 18 which is secured to a machine frame 15 with screws 16, by inserting the bush 13 into a hole **18*a* defined in attaching member 18 and securing to the member 18 with stepped screws 20**.

The feed adjusting member 3 has a central hole **3*a* for the bush 13 and, at both ends thereof, arc-shaped oblong holes 3*b* moving around an axis of the output shaft 12. The stepped screws 20 are mounted into the oblong holes 3*b* with the stepped portions 20*a* thereof. Accordingly, the feed adjusting member 3 may turn around the axis of the output shaft 12 due to a space between the oblong holes 3*b* and the stepped portions 20*a***.

The drive gear 4 is fixed via a screw 21 on the output shaft 12 extending from the feed adjusting member 3.

The follower gear 5 is shaped as a segment and is in mesh with the drive gear 4. Gear 5 is formed with a hole **5*a* at a rotating center thereof for mounting on a pivot 22 implanted at one end of the feed adjusting member 3, and further is restrained against the movement in the axial direction by means of a collar 24 secured via a screw 23 to the pivot 22 and against rotation by means of a pair of stopper pins 25**.

The feed adjusting arm 6 is fixed, with a screw 27, on one end of a feed rotation shaft 26 pivoted on the machine frame 15. The feed rotation shaft 26 is secured, at its other end, with a feed adjuster 29 which is one member of the feed adjusting device 28. Accordingly, when the feed rotation shaft 26 is rotated, the feed adjusting device 28 is actuated via the feed adjuster 29.

The connecting rod 8 is formed at its both ends with holes **8*a*, into which fixing pins 30 and 31 are inserted and secured with stopper rings 32, so that the connecting rod 8 is restrained against the axial movement. The fixing pin 30 is implanted in the follower gear 5 and the fixing pin 31 is implanted in the feed adjusting arm 6**.

The fine feed-adjusting member 9 comprises a shaft part **9*a* and an eccentric part 9*b*, and is provided with a flange part 9*c* at one end of the shaft part 9*a*. The shaft part 9*a* is mounted and restrained against the axial movement in a pair of holes 18*c* formed in bent portions 18*b* of the attaching member 18. The eccentric part 9*b* is cylindrical as well as the shaft part 9*a*, and the eccentricity thereof is determined at such a position by an eccentric amount e with respect to the eccentricity of the shaft part 9*a***.

The eccentric part **9*b* is adapted to fit into a groove 3*c* formed as an extension from a hole 3*d* at one end of the feed adjusting member 3. If the fine feed-adjusting member 9 is rotated via a groove 9***d*, the feed adjusting member 3 is rotated about the axis of the output shaft 12, to rotate the feed adjusting member 6 via the connecting rod 8 and provide fine adjustment of the feed pitch.

The hole 3*d* formed in continuity of the groove 3*c* is an idle hole for holding the shaft part 9*a* of the member 9.

The device of the present invention is actuated as follows. If the pulse motor 2 rotates, the follower gear 5 rotates about a pivot 22 via the drive gear 4. Then, the feed adjusting member 6 rotates about the feed rotation shaft 26 via the connecting rod 8, and the feed adjusting device 28 is actuated by the feed adjusting device 29, whereby the feed pitch may be adjusted.

Figure 3:
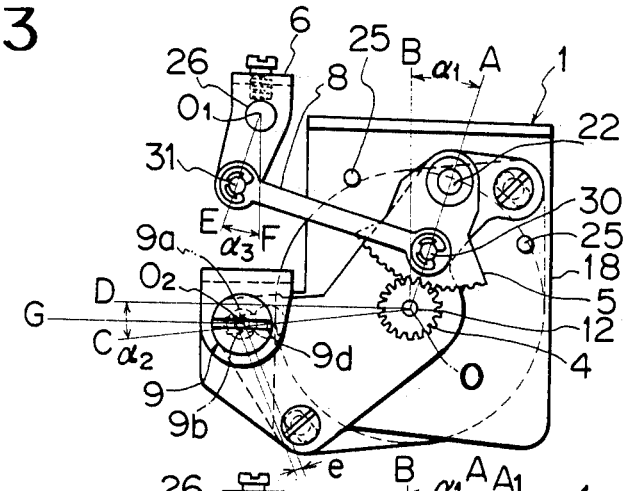
Figure 4:
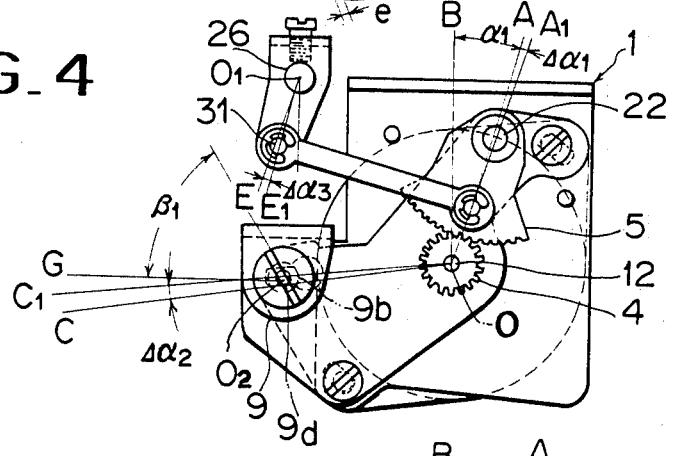
Figure 5:
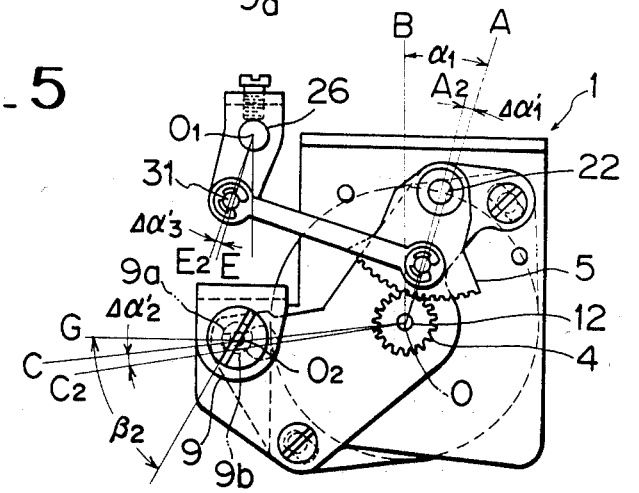
Figure 6:
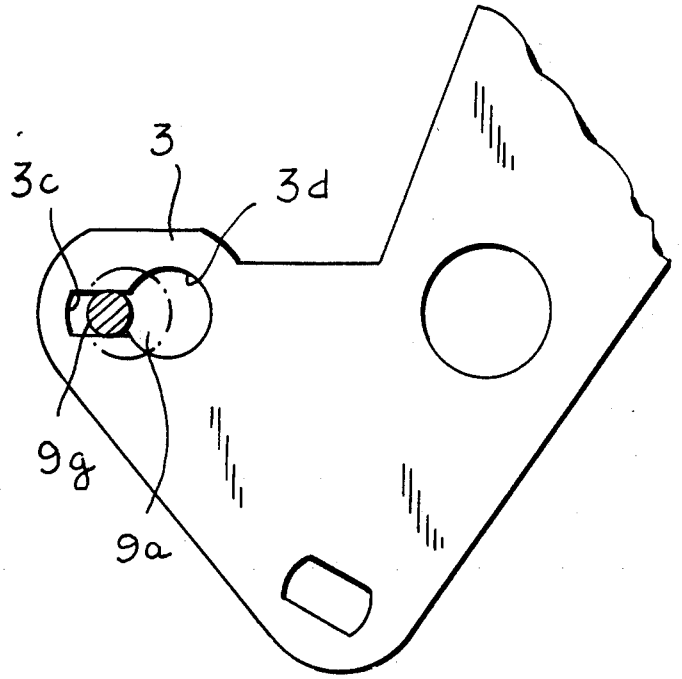
FIG. 6 is a side view on an enlarged scale of a section of the feed adjusting member with the fine-feeding adjusting member.

FIG. 3 shows the fine condition of the feed-adjusting device 1 when the feed pitch is zero. A line 0-A between the axis of the output shaft 12 and the axis of the pivot 22, is tilted by an angle $\alpha_1$ toward the right with respect to a vertical line 0-B running through the axis of the output shaft 12. A line 0-C between the axis of the output shaft 12 and the axis of the eccentric part 9*b* of the fine feed-adjusting member 9, is tilted by an angle $\alpha_2$ downward with respect to a horizontal line 0-D running through the axis of the output shaft 12. A line $0_1$-E between the axis of the feed rotation shaft 26 and the axis of the fixing pin 31, is tilted by angle $\alpha_3$ toward the left with respect to a vertical line $0_1$-F running through the axis of the feed rotation shaft 26. The groove 9*d* of the feed fine-adjusting member 9 is positioned on a horizontal line $0_2$-G running through the shaft part 9*a*.

From the above described state, a slight pitch is made to the forward feed by rotating the fine feed-adjusting member 9 to the clockwise direction such that, for example, the groove 9*d* is tilted upward with respect to the horizontal line $0_2$-G. Then, the line 0-$C_1$ between the axis of the output 12 and the axis of the eccentric part 9*b* of the fine feed-adjusting member 9, is tilted by $\Delta\alpha_2$ upward. At the same time, the line 0-$A_1$ between the axis of the output shaft 12 and the axis of the pivot 22, is tilted by angle $\Delta\alpha_1$ toward the right with respect to the line 0-A. Thereby, the line $0_1$-$E_1$ between the axis of the feed rotation shaft 26 and the axis of the fixing pin 31, is tilted by angle $\Delta\alpha_3$ via the connecting rod 8 toward the right with respect to the line $0_1$-$E_1$, whereby the feed adjusting device 28 is actuated via the feed adjuster 29, and a slight pitch is made to the forward feeding side.

From the state shown in FIG. 3, a slight pitch is made to the backward feed by rotating the fine feed-adjusting member 9 in the counterclockwise direction such that, for example, the groove 9*d* is tilted by an angle $\beta_2$ toward the horizontal line $0_2$-G. Then, the line 0-$C_2$ between the axis of the output shaft 12 and the axis of the eccentric part 9*b* of the fine feed-adjusting member 9, is tilted by angle $\Delta\alpha'_2$ downward with respect to the line 0-C. At the same time, the line 0-$A_2$ between the axis of the output shaft 12 and the axis of the pivot 22, is tilted by angle $\Delta\alpha'_1$ to the left. Thereby, the line $0_1$-$E_2$ between the axis of the feed rotation shaft 26 and the axis of the fixing pin 31, is tilted by angle $\Delta\alpha'_3$ via the connecting rod 8 to the left with respect to the line $0_1$-$E_1$ so that the feed adjusting device 28 is actuated via the feed adjuster 29, and the feed pitch is made to the backward feed.

As mentioned above, according to the invention, if the fine feed-adjusting member 9 is rotated by turning such as a screw drive inserted in the groove 9*d*, the fine adjustment may be made for the pitch of the forward or backward feed. For example in the buttonhole stitching, if the forward feed stitching at the left is slightly smaller than the backward feed stitching at the right, and then the feed-adjusting member 9 is rotated in the clockwise direction, the forward feed pitch is made larger, whereby the stitchings of the forward feed and the backward feed may be made equal.

The device of the present invention is formed and actuated as described above, wherein the feed adjusting device is operated by means of the pulse motor as the power source which is attached to the attaching member fixed to the machine frame of the sewing machine, and the feed adjusting member is pivoted relative to the attaching member such that it is turned about the axis of the output shaft of the pulse motor by rotating the fine feed-adjusting member the eccentric part of which is mounted in the groove defined in the feed adjusting member, and therefore, with respect to the feed pitch, the fine adjustment may be easily made by means of the simple and durable structure.

It will be understood that each of the elements described above, or two or more together, may also find a useful application in other types of sewing machines differing from the types described above.

While the invention has been illustrated and described as embodied in a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fine-feed adjusting device for a sewing machine provided with a feed adjustment device actuated by means of a drive pulse motor having an output shaft and mounted to an attaching member secured to a machine frame of the sewing machine, comprising a feed adjusting member mounted on said attaching member and pivotable relative to said output shaft such that it is turned about an axis of said output shaft; a drive gear mounted on said output shaft; a follower gear meshed with said drive gear and pivotally supported at an end of said feed adjusting member; means for operating the feed adjustment device including a feed rotation shaft rotatably pivoted to the machine frame, and a feed adjusting arm secured on the feed rotation shaft; a connecting rod pivotable between said feed adjusting arm and said follower gear; and a fine-feed adjusting member rotatably supported in said attaching member and having an eccentric portion inserted in a groove formed in said feed adjusting member, said fine-feed adjusting member being rotated by an external force so as to turn said feed adjusting member to make a fine adjustment to a feed pitch.

2. The device as defined in claim 1, wherein said feed adjusting arm carries one fixing pin and said follower gear carries another fixing pin, said connecting rod being pivotable between said one fixing pin and another fixing pin.

3. The device as defined in claim 2, wherein said follower gear is segment-shaped.

4. The device as defined in claim 2, wherein said feed adjusting member carries a pivot, on which said follower gear is pivotally supported.

* * * * *